United States Patent [19]

Wissman et al.

[11] Patent Number: 4,799,846

[45] Date of Patent: Jan. 24, 1989

[54] TRANSFER BELT FOR CAN END CONVERSION PRESS

[75] Inventors: Terry L. Wissman, New Bremen; Robert L. Schockman, St. Henry, both of Ohio

[73] Assignee: The Minster Machine Co., Minster, Ohio

[21] Appl. No.: 121,043

[22] Filed: Nov. 16, 1987

Related U.S. Application Data

[62] Division of Ser. No. 936,466, Nov. 25, 1986, Pat. No. 4,723,882.

[51] Int. Cl.[4] ..... B21D 51/44

[52] U.S. Cl. ..... 413/66; 72/361; 72/405; 198/803.8; 198/803.15

[58] Field of Search ..... 413/12, 14, 66; 72/346, 72/361, 405, 422; 198/803.8, 803.15, 803.14

[56] References Cited

U.S. PATENT DOCUMENTS

| | | | |
|---|---|---|---|
| 3,177,091 | 4/1965 | Case et al. | 198/803.15 |
| 3,196,817 | 7/1965 | Fraze | 413/66 |
| 3,231,065 | 1/1966 | Kominski et al. | 198/803.15 |
| 3,245,370 | 4/1966 | Bofinger | 413/64 |
| 3,366,086 | 1/1968 | Fraze | 413/14 |
| 3,470,837 | 10/1969 | Fraze et al. | 413/66 |
| 3,550,546 | 12/1970 | Eickenhorst | 413/64 |
| 3,683,665 | 8/1972 | Bradlee | 72/405 |
| 3,683,834 | 8/1972 | Potts et al. | 413/66 |
| 3,858,432 | 1/1975 | Voorhees et al. | 72/455 |
| 3,860,107 | 1/1975 | Cioni et al. | 198/803.15 |
| 4,026,226 | 5/1977 | Hahn et al. | 72/455 |
| 4,213,324 | 7/1980 | Kelley et al. | 72/405 |
| 4,475,278 | 10/1984 | Schockman et al. | 29/434 |
| 4,546,873 | 10/1985 | Debenham et al. | 198/836 |
| 4,568,230 | 2/1986 | Brown | 413/66 |

FOREIGN PATENT DOCUMENTS

| | | | |
|---|---|---|---|
| 0124832 | 11/1901 | Fed. Rep. of Germany | 72/346 |

*Primary Examiner*—Frederick R. Schmidt
*Assistant Examiner*—Robert Showalter
*Attorney, Agent, or Firm*—Jeffers, Hoffman & Niewyk

[57] ABSTRACT

A conversion press assembly for forming easy open beverage cans and a transfer belt conveyor therefor. The press assembly comprises a main press having tooling therein for forming the can ends and a can end transfer belt extends therethrough to carry can end blanks from a downstacker or other supply apparatus. Attached to the main press frame is an auxiliary, tab press having its own crankshaft but being driven off the same drive assembly as the main press. Strip stock is fed into the tab press wherein the tabs are formed, and the tabs, still in strip form, are then fed transversely into the main press for attachment to the can ends at a stacking station. The transfer belt comprises a plurality of carriers mounted on a flexible belt wherein the carries include flexible fingers for resiliently gripping the can ends.

17 Claims, 9 Drawing Sheets

TRANSFER BELT FOR CAN END CONVERSION PRESS

This is a division of application Ser. No. 936,466, filed Nov. 25, 1986 now U.S. Pat. No. 4,723,882.

BACKGROUND OF THE INVENTION

1. Field of the Invention

The present invention relates to an apparatus for forming easy-open can ends and the tabs therefor. More specifically disclosed is a press assembly with a multiple lane conveyor operable in a main-frame press, and an appended but independent tab-forming apparatus, which conveyor, press and tab apparatus are operable by a single drive system.

2. Prior Art

Easy-open can end presses cooperating with tab-forming means are known in the art. U.S. Pat. No. 3,245,370—Bofinger discloses a device having a pair of counter-rotating turrets which slightly overlap at one portion of their peripheries. Each turret is provided with a plurality of spaced apertures that are coaxial or aligned with the apertures of the other turret in the region of overlap.

U.S. Pat. No. 3,683,665 relates to a press wherein main tooling is mounted to the main slide and auxiliary tooling, such as that which could be utilized for forming tabs, is driven by auxiliary slides driven off the same crankshaft as the main slide.

U.S. Pat. No. 3,366,086—Fraze teaches a method of forming container tops having tear strip tabs for removal and opening of the container tops. The basic steps of the method are illustrated in FIG. 1 and include a final stage of forming the finished top onto a container, generally a can.

A machine having a main dial plate rotating intermittently and carrying several can ends through work stations is disclosed in U.S. Pat. No. 3,470,837—Fraze et al. A feed mechanism has a stack of can ends, supported in a storage means for feeding through a feed spiral to the main dial plate for processing. The main dial plate is provided with relatively large apertures for nests to receive and support can ends of a particular size and shape. The tabs are preformed on a separate machine and are columnarly arranged above a rearward section of the slide.

U.S. Pat. No. 3,550,546—Eikenhorst illustrates a machine utilizing a main dial plate intermittently rotated to carry can ends through a series of work stations for conversion into easy-open can ends. Tabs for the easy-opening can ends are made in a tab die operable by the ram of the press of the machine, which tabs are fed on a strip to a staking station and affixed to the formed can ends. Tab and can end formation are performed as an integral operation within the press by operation of the single ram. The tab die is generally located on the bolster bed in proximity to the dial plate and tab feeding mechanism.

U.S. Pat. No. 3,683,834—Potts et al discloses a press apparatus for applying ring tabs to a can end and for performing a plurality of sequential operations on a container end closure. The work stations are arcuately arranged on a rotating turntable 11 and various operations are performed on the can end closures as they pass through the work stations. Similarly, tabs are provided by a plurality of sequential operations in a progressive tab die section 13. Tabs and formed end closures are joined in the combination die assembly which includes progressive die section 13.

U.S. Pat, No. 4,026,226—Hahn et al shows a press apparatus and method for inverted conversion of easy-open metal container ends, which combines the functions of end and tab forming. The tab forming and end forming stations are disposed one above the other and are alternately operable by a vertically reciprocal slide assembly. Continuous stock strip is provided to a vertically arranged tab die set, which loops through and above the formed can ends. The can ends are provided in a dual lane transfer bed arrangement and the formed tabs are staked to the can ends.

A press for converting can ends and the like for an easy opening can structure is disclosed in U.S. Pat. No. 4,568,230—Brown. Upper and lower conversion tooling are located along a converting path at the top and bottom of a conveyor. The conveyor defines a dual lane plurality of stations on opposite sides of the center of the tooling for forming the shells moved by the conveyor. Tab forming tooling, auxiliary to the main tooling, is located on opposite sides of the conveyor and extends transversely of the main tooling. A tab forming path bridges the end of the converting path. Tabs are formed from a strip of metal fed through the tab tooling and guided in a loop to a staking and attachment station of the can end converting path for removal from the strip and attachment to the formed can ends. The can end tooling and tab forming tooling are cooperatively aligned between the guide rods and are operable by the same vertical reciprocal motion of the upper plate of the press.

U.S. Pat. No. 4,213,324—Kelly et al discloses a carrier means for a punch press to secure sheet metal work pieces through successive work stations while maintaining precision alignment between these work stations and relieving clamping pressure between the periphery of the sheet metal and the carrier means. The feed mechanism can be either a belt or a turret type assembly.

U.S. Pat. No. 4,456,873—Debenham et al illustrates an article retention system for transfer equipment particularly for carrying can ends through a series of progressive die work stations. A belt having openings therein for nesting a can end blank runs between fixed rail overlays on the can end edges to secure them in the belt during indexing. Spring actuated means are provided to maintain the belt in contact with the over-the-edge rails.

U.S. Pat. No. 4,475,278—Schockman et al discloses a specific mechanical press structure utilized in part in the press assembly of this application. Said patent is hereby incorporated by reference.

The prior art, generally, teaches a single press utilizing tooling arranged between a bolster and slide, which may have progressive tooling or die arrangements located thereon. Alternatively, the tabs of the easy-open can ends may be provided as finished pieces for joining with the formed can end blanks. Location and retention of the can ends within a conveying belt or turret has represented a problematic area.

In prior art presses where the tab tooling and main can end tooling are reciprocated by the same slide, the slide and its associated tooling area must be sufficiently large to accommodate the number of required tooling stations for both the tabs and can ends. Particularly in a multiple lane conversion press, this typically results in a press which has a high tonnage requirement. If the tab slide is separate from the main slide, it may be possible to make more efficient utilization of space. However, the tab slide is driven by a connecting arm connected to the same crankshaft as the main slide, there results a situation where the much smaller tab slide is being driven by a much larger drive system than is necessary because the crankshaft must also reciprocate the main slide. It is desirable to provide a conversion press assembly wherein the tab tooling and the main can end tooling can be conveniently arranged and the respective sets of tooling can be reciprocated by the efficient application of press tonnage.

SUMMARY OF THE INVENTION

The present invention in one form thereof, particularly relates to a transfer belt on a press assembly for producing easy-open can having a first press for forming the easy-open can end workpieces and a second press for forming the tabs for the easy-open can ends which second press is laterally displaced from the first press working zone. A multiple lane conveyor transfers the can ends into the working zone of the first press which working zone accommodates tooling generally mounted on the slide and die bed or bolster. The tooling may be progressive tooling for the forming operations on the can ends. The tabs formed on the second press are transferred to a staking station for joining with the formed can ends and the scrap strip stock is shredded in a scrap shredder associated with the press. The first press, second press, and the conveyor transfer system are coupled to a single drive system. Further, a resilient can-end grasping carrier mounted on the conveyor is provided for retaining the can end blanks during the forming operations.

The press assembly comprises separate crankshafts for the tab press and main can end press, respectively, wherein the crankshafts are driven by a single drive system, preferably mounted to the crown of the main press. This permits the tab press crankshaft and slide to be of smaller size and weight, due to the lower forces required for tab forming, thereby resulting in lower inertias and smaller power requirements.

Different stroke lengths can be established for the tab tooling and can end tooling and the shutheights for the respective presses can be adjusted independently without the necessity for shimming, which was often the case in prior art conversion presses wherein the tab tooling and can end tooling were carried by the same slide. Because the tab and can end slides are driven by separate crankshafts, individual phase adjustment of the slides can be accomplished. Furthermore, by locating the tab tooling outside the working zone of the main press, better access can be had to both the tab tooling and can end tooling.

The present application relates to a transfer mechanism for moving the can ends into the press and through the various tooling stations. The can ends are resiliently grasped by a plurality of carriers which are secured to a flexible belt. Thus, the mechanism for grasping and retaining the can ends is separate from the belt itself. Furthermore, the carriers are permitted to self-adjust in relationship to the apertures within the belt so that any misalignment between the carriers and downstacker or tooling, for example, can be automatically corrected.

BRIEF DESCRIPTION OF THE DRAWINGS

In the several figures of the drawings, like reference numerals identify like components, and in the drawings.

DETAILED DESCRIPTION OF THE INVENTION

Figure 1:
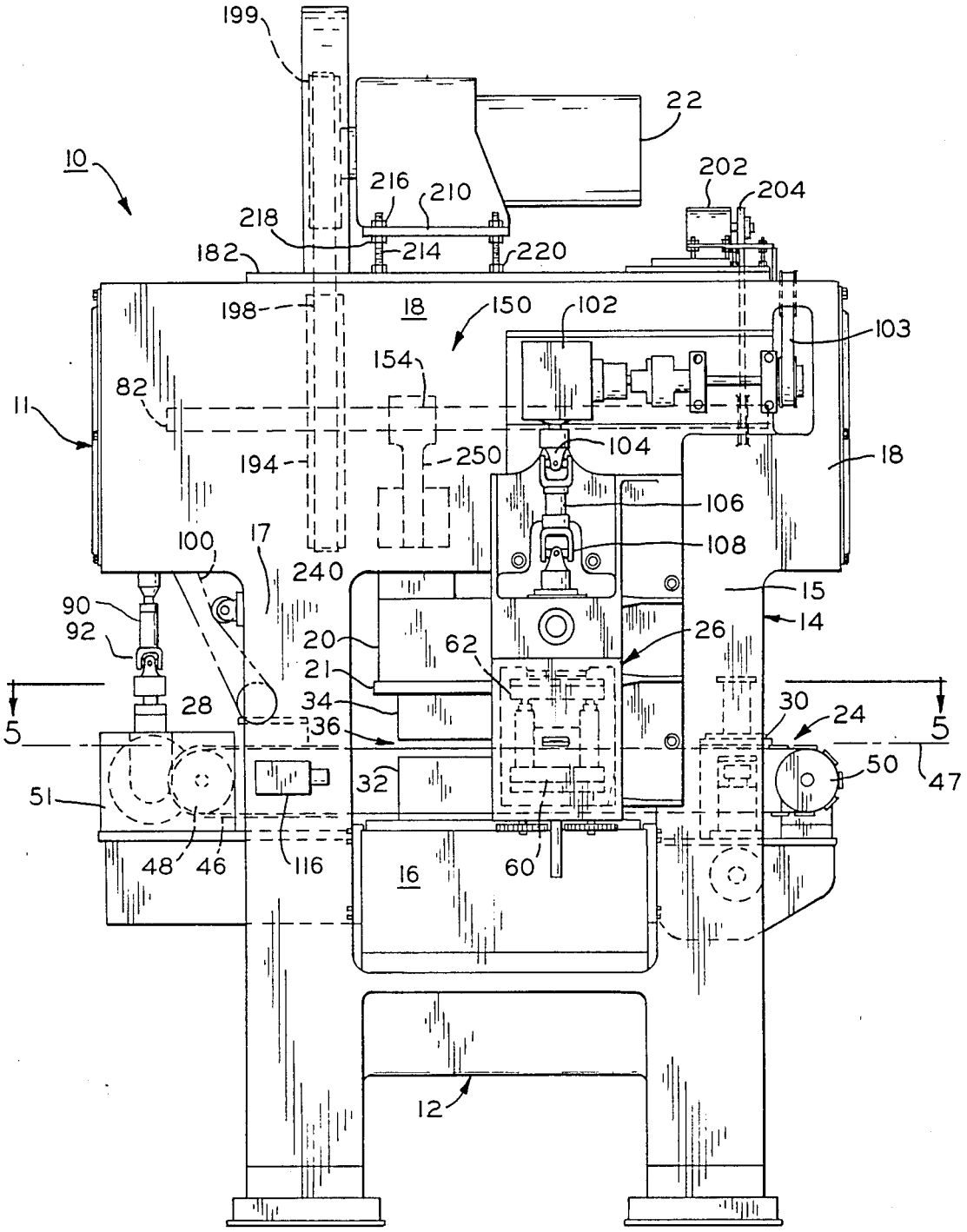
FIG. 1 is a front elevational view of the press assembly.

Press assembly 10 comprises a main press 11 including a bed 12, a frame 14, a bolster 16 mounted on bed 12, and a crown 18 vertically positioned above bed 12 and bolster 16. Slide 20 and slide plate 21 are coupled to and operable by drive assembly 150 (FIG. 10) mounted in crown 18. Press assembly 10 includes a belt transfer conveyor 24 for the transfer of can end workpieces 135 (FIGS. 8 and 9) and a tab press 26 illustrated in FIG. 4 as being mounted on frame 14 and laterally displaced from transfer conveyor 24. Can end blanks are provided through a supply apparatus comprising a conventional downstacker 28. An upstacker 30 is mounted on press 11 for ejection from belt 24 and restacking of completed, fully formed easy-open can ends. Downstacker 28 and upstacker 30 are located at opposite ends of transfer belt 24 outside the working zone 36 defined between slide 20 and bolster 16.

Main press 11 has lower can end tooling 32 mounted on bolster 16 within frame 14 and upper can end tooling 34 mounted on slide 20 in vertical alignment as shown in FIGS. 1–4 and defining therebetween working zone 36. Upper and lower can end tooling 32 and 34 can be conventional in nature and constitutes a progressive die which deforms, scores and stakes tabs on the can ends 135 in a series of operations.

Figure 5:
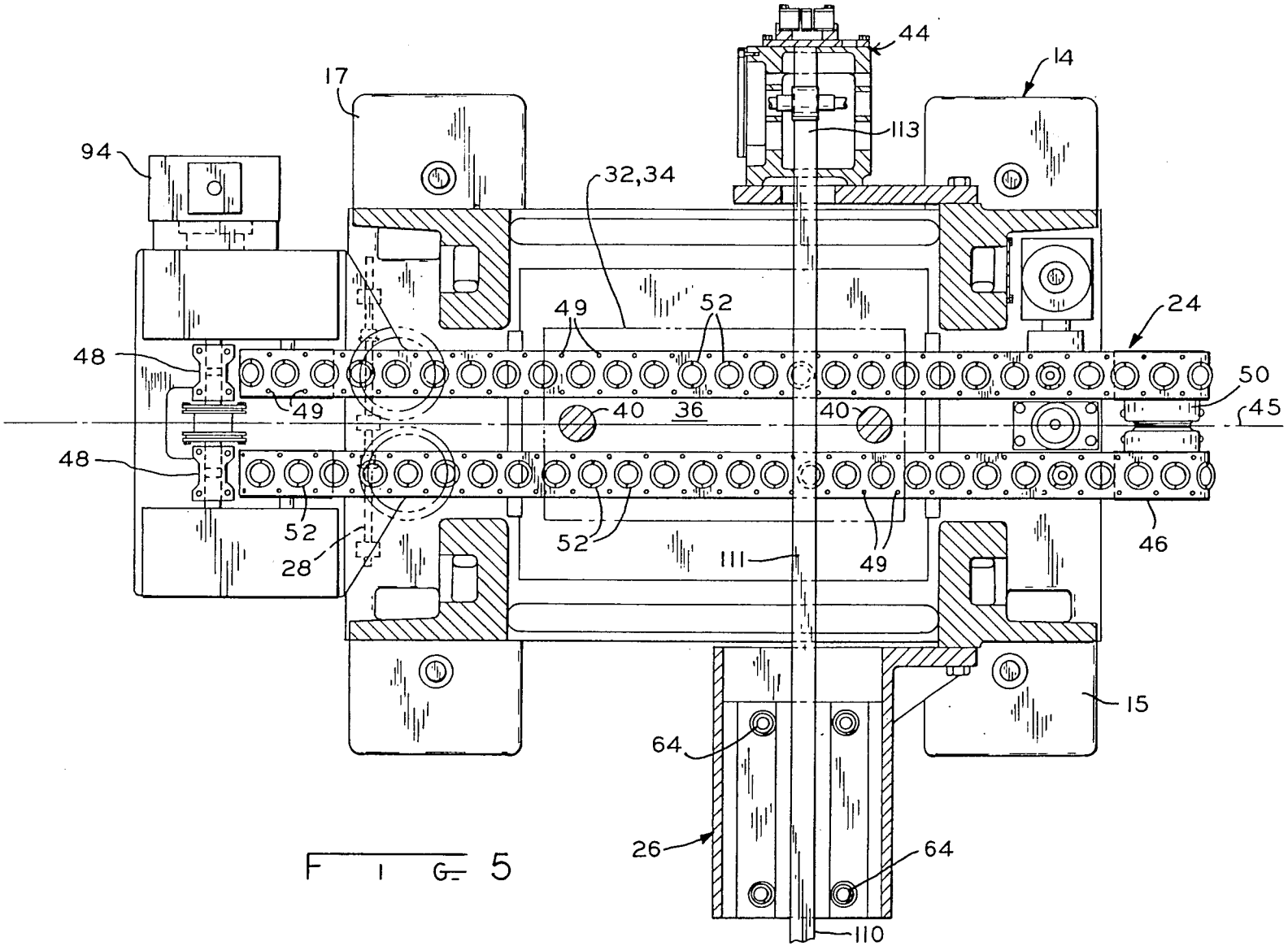
FIG. 5 is a sectional top view of the press assembly taken along line 5—5 of FIG. 1 with portions removed for clarity.

FIG. 5 illustrates transfer belt 24 extending through main press 11 and shows the location of die sets 32 and 34. In FIG. 5, the relationship of downstacker 28 and upstacker 30 are shown to be external of working zone 36 defined between upper and lower can end tooling 32, 34. Die guides 40 serve to accurately guide upper tooling 34 with respect to lower tooling 32.

Figure 10:
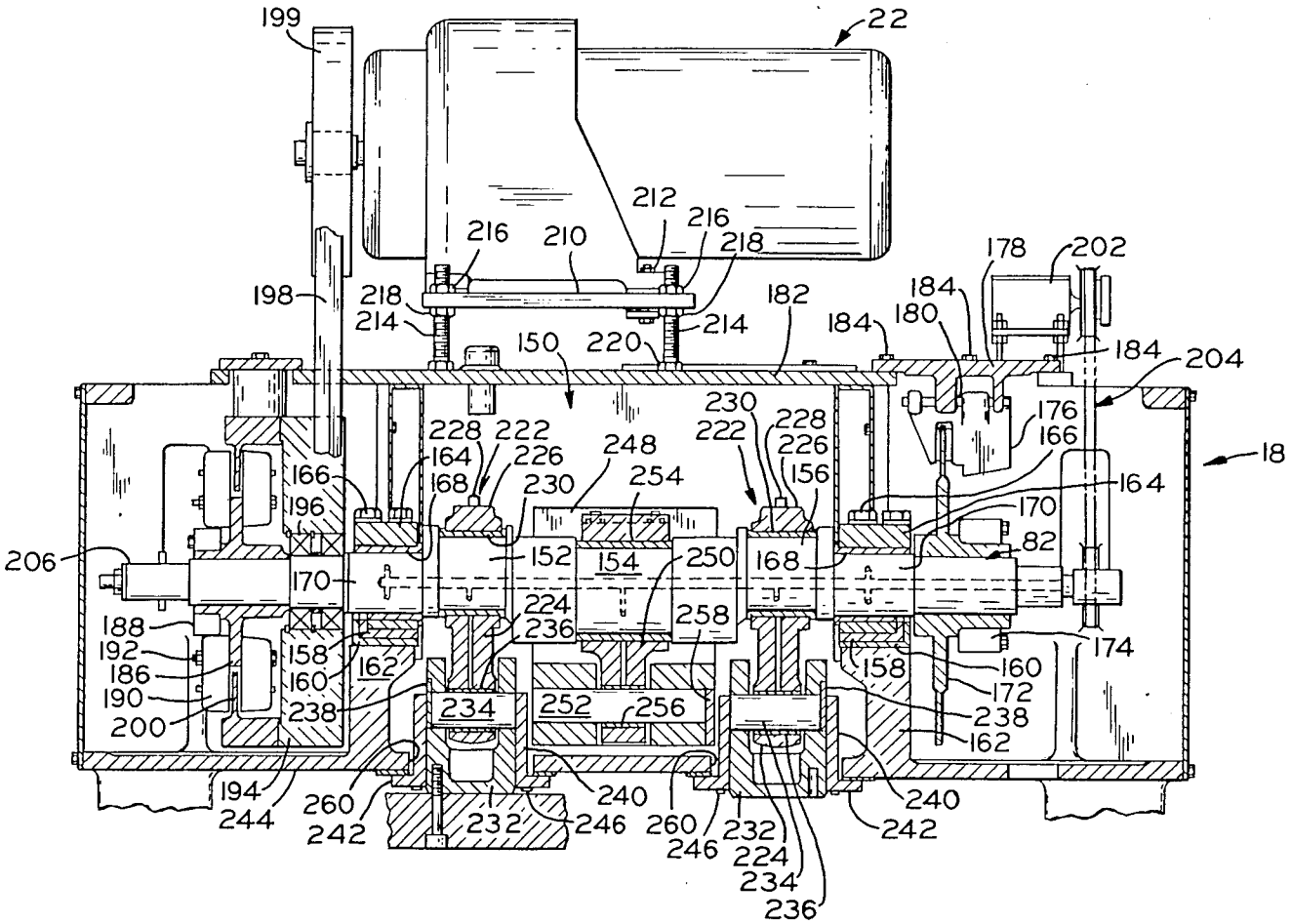
FIG. 10 is a sectional view of the crown and drive assembly of the main press taken along line 10—10 of FIG. 3.

Although a particular type of press and drive is detailed in FIG. 10, which drive is that disclosed in Shockman et al U.S. Pat. No. 4,475,278, the present invention is not limited to this particular type of press. Accordingly, this press is merely an example of one which may be used in a particular embodiment of the present invention.

As shown in the Schockman et al U.S. Pat. No. 4,475,278, slide 20 may be mounted on guideposts that are rigidly connected to and depend downwardly from crown 18 and is adapted to slide on the guideposts in a rectilinear manner within the opening 36 between crown 18 and bolster 16 and between left and right pairs of uprights 15 and 17. Alternatively, slide 20 could be guided on two guide pistons without the necessity for separate guide posts.

Referring now to FIGS. 1 and 10, drive assembly 150 will be described in greater detail. Drive assembly 150 comprises crankshaft 82 having three eccentrics 152, 154 and 156 thereon, crankshaft 82 being rotatably supported within main bearing blocks 158, which are supported on the upper support surfaces 160 of pads 162. Bearing blocks 158 are of the split type and each comprise a cap 164 connected to the lower portion thereof and to pads 162 by bolts 166. Main bearings 168 are mounted within bearing blocks 158 and the portions 170 of crankshaft 82 are journalled therein.

A brake disk 172 is mounted to the right most end of crankshaft 82 as viewed in FIG. 10 by means of ringfeder 174, and a brake caliper 176 is mounted to bracket 178 by stud and nut assembly 180 such that it engages brake disk 172 when energized. Bracket 178 is connected to cover plate 182 by screws 184.

In FIG. 10, a clutch hub 186 is frictionally clamped to crankshaft 82 by ringfeder 188, and has a plurality of calipers 190 rigidly connected thereto by bolts 192. Alternatively, a single disc clutch (not shown) could be employed. A flywheel 194 is rotatably supported on crankshaft 82 by bearings 196 and is driven by flat belt 198. Belt 198 is disposed around motor pulley 199, which is driven by motor 22. When motor 22 is energized, flywheel 194 constantly rotates but does not drive crankshaft 82 until the clutch device 190 is energized. At that time, the friction disk 200 of flywheel 194 is gripped and the rotating motion of flywheel 194 is transmitted to crankshaft 82 to calipers 190 and hub 186. Solid-state limit switch 202 is driven by a pulley and belt arrangement 204 from the end of crankshaft 82 and controls various press functions in a manner well known in the art. Rotary oil distributor 206 supplies oil to clutch 190.

Motor 22 is connected to cover plate 182 by means of mounting plate 210 and bolts 212, plate 210 being connected to cover plate 182 by studs 214 and locknuts 216, 218, and 220. The tension on belt 198 can be adjusted by repositioning plate 210 on studs 214 by readjusting the positions of lock nuts 216 and 218 along studs 214.

In the preferred embodiment, the drive assembly 150 comprises two connection assemblies 222 each comprising a connection arm 224 having a connection cap 226 connected thereto by stud and nut assembly 228. Bearings 230 are disposed between the respective connection arms 224 and the eccentrics 152 and 156 of crankshaft 82. Connection assemblies 222 are similar to those disclosed in U.S. Pat. No. 3,858,432, and comprise pistons 232 pivotably connected to connection arms 224 by wrist pins 234 and bearings 236. Keys 238 lock wrist pins 234 to pistons 232.

Pistons 232 are slideably received within cylinders 240, the later including flanges 242 connected to the lower surface 244 of crown 18 by screws 246 and sealed thereagainst by O-rings. Seals provide a sliding seal between pistons 232 and their respective cylinders 240 and are held in place by seal retainers and screws.

Press 11 is dynamically balanced to counteract the movement of connection assemblies 222 and slide 20 by means of a balancer weight 248 connected to the eccentric 154 of crankshaft 82 by counterbalance connection arm 250 and wrist pin 252. Bearings 254 and 256 have eccentric 154 and wrist pin 252, respectively, journalled therein, and key 258 locks wrist pin 252 to weight 248. Weight 248 is guided by means of a pair of guide pins connected to the lower surface 244 of the crown by screws.

Slide 20 center portion is connected to the protruding ends of pistons 232 by screws extending through the central portion of slide 20 and slide plate 21 is connected to the slide center portion by screws. As shown in FIG. 10, pistons 240 extend through openings 260 in the bottom of crown 18.

Figure 2:
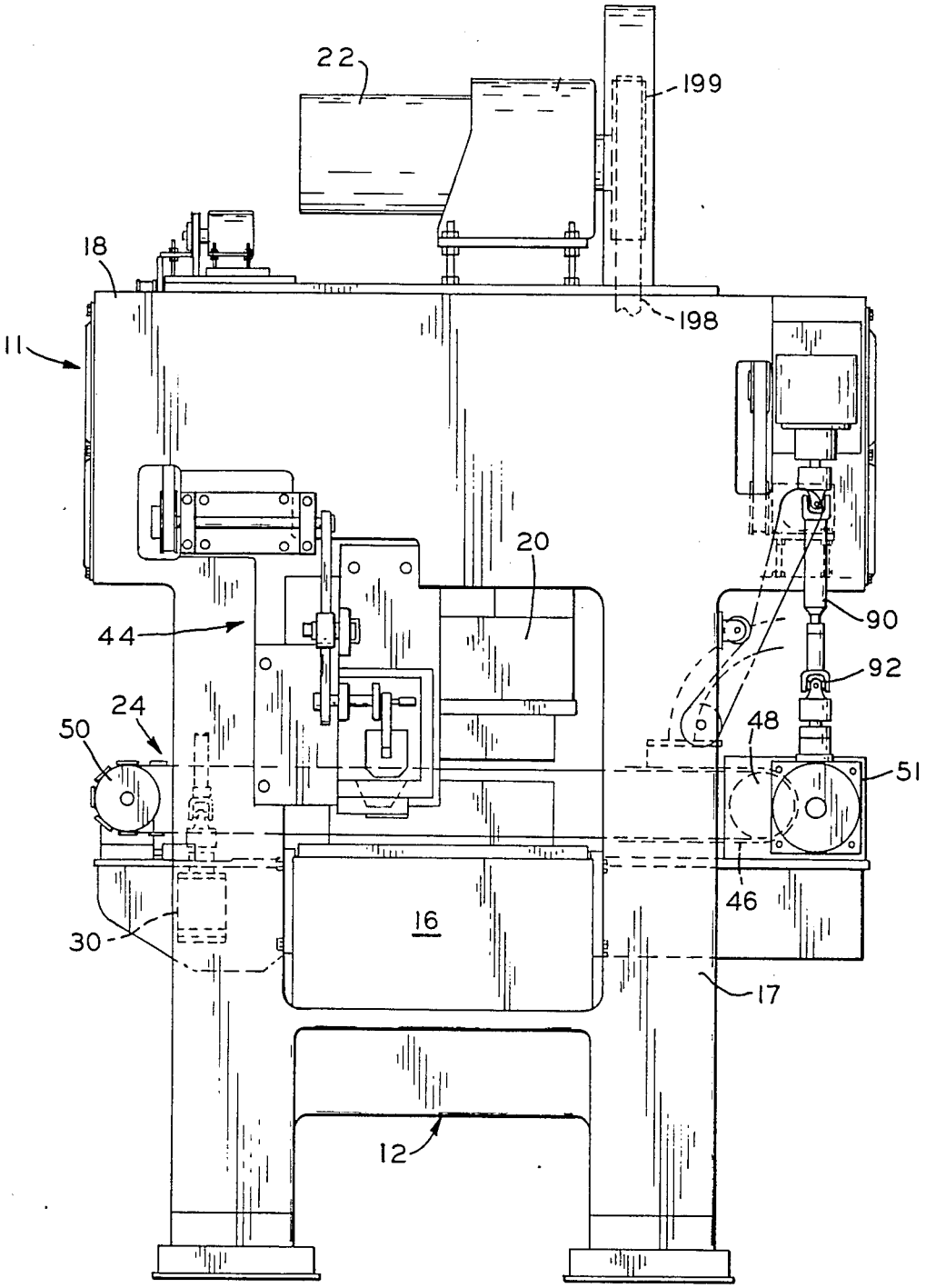
FIG. 2 is a rear elevational view of the press assembly.
Figure 3:
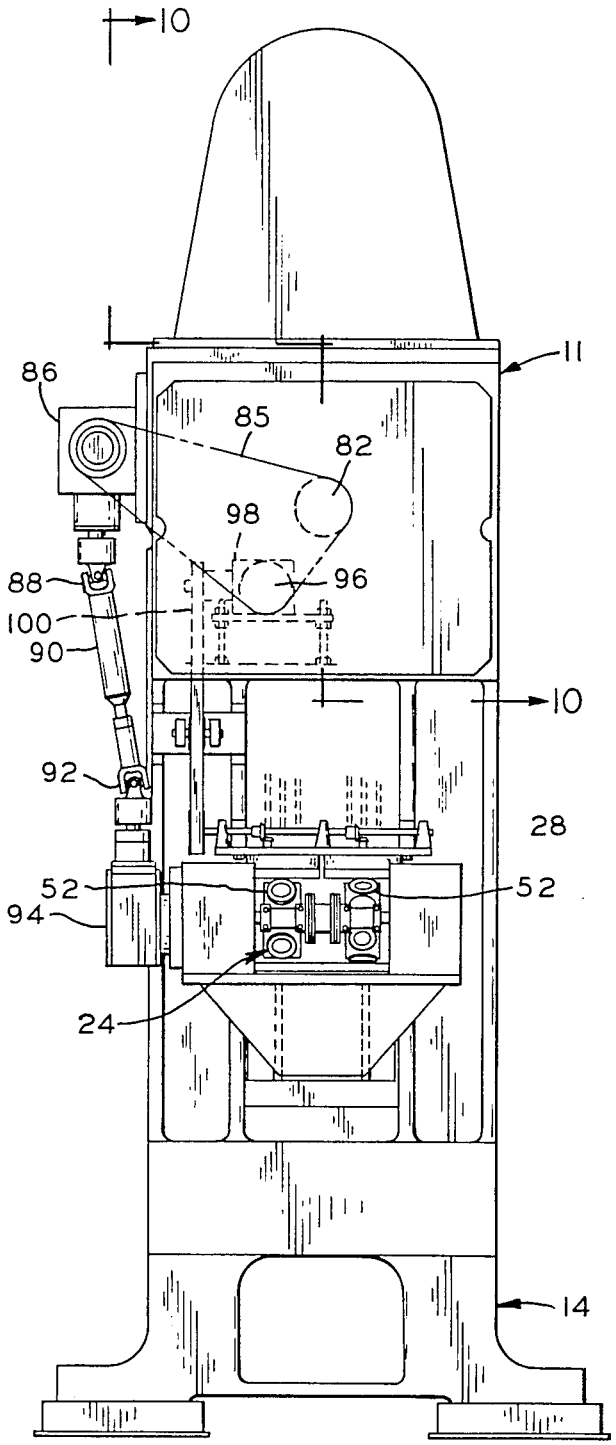
FIG. 3 is a lefthand elevational side view of the press assembly.
Figure 8:
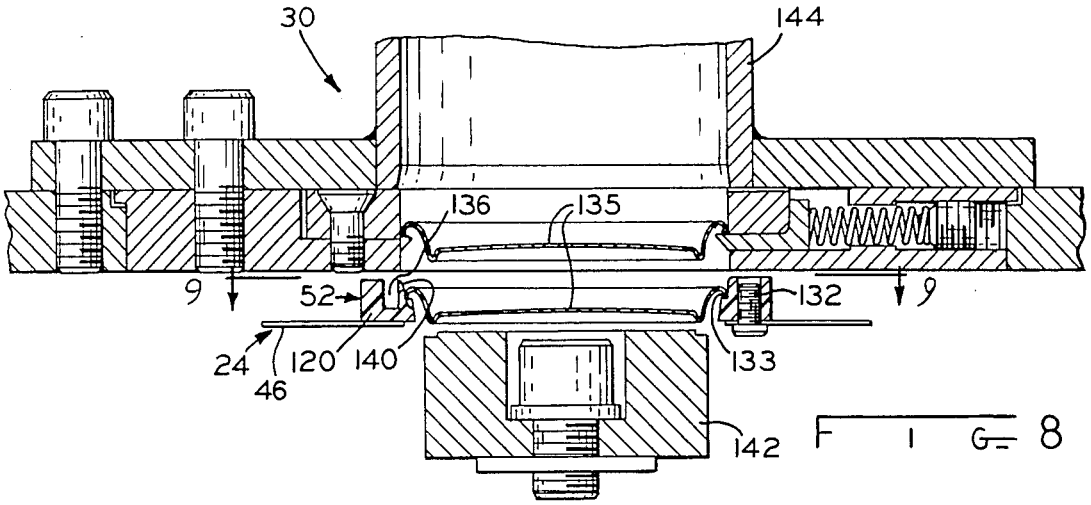
FIG. 8 illustrates in cross section the transfer belt and upstacker.
Figure 9:
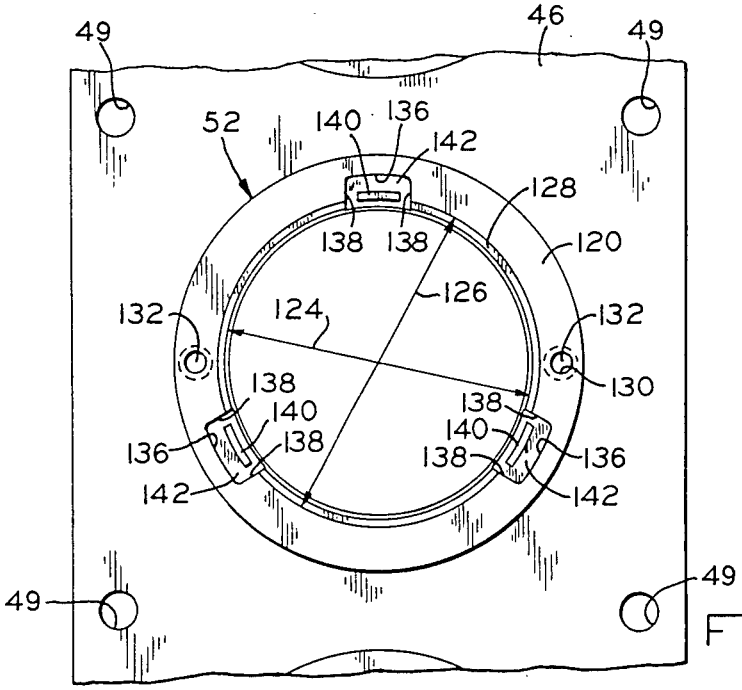
FIG. 9 is a top view of the belt of FIG. 8 viewed along line 9—9.

As illustrated in FIGS. 1, 2 and 5, transfer conveyor 24 is a multiple-lane, continuous belt 46 operable between drive pulley 48 and idler pulley 50, the former being driven by gear box 94. Belt 46, as shown in FIGS. 5, 8 and 9, comprises multiple can-end receiving carriers 52 which index through workstations in working zone 36 between can end tooling 34, 36. Belt 46 may include a series of holes 49 engageable with teeth (not shown) on pulleys 46 and 48 to index belt 46. Belt 46 defines a horizontal plane 47 (FIG. 1) generally parallel to bed 12 and bolster 16.

Figure 6:
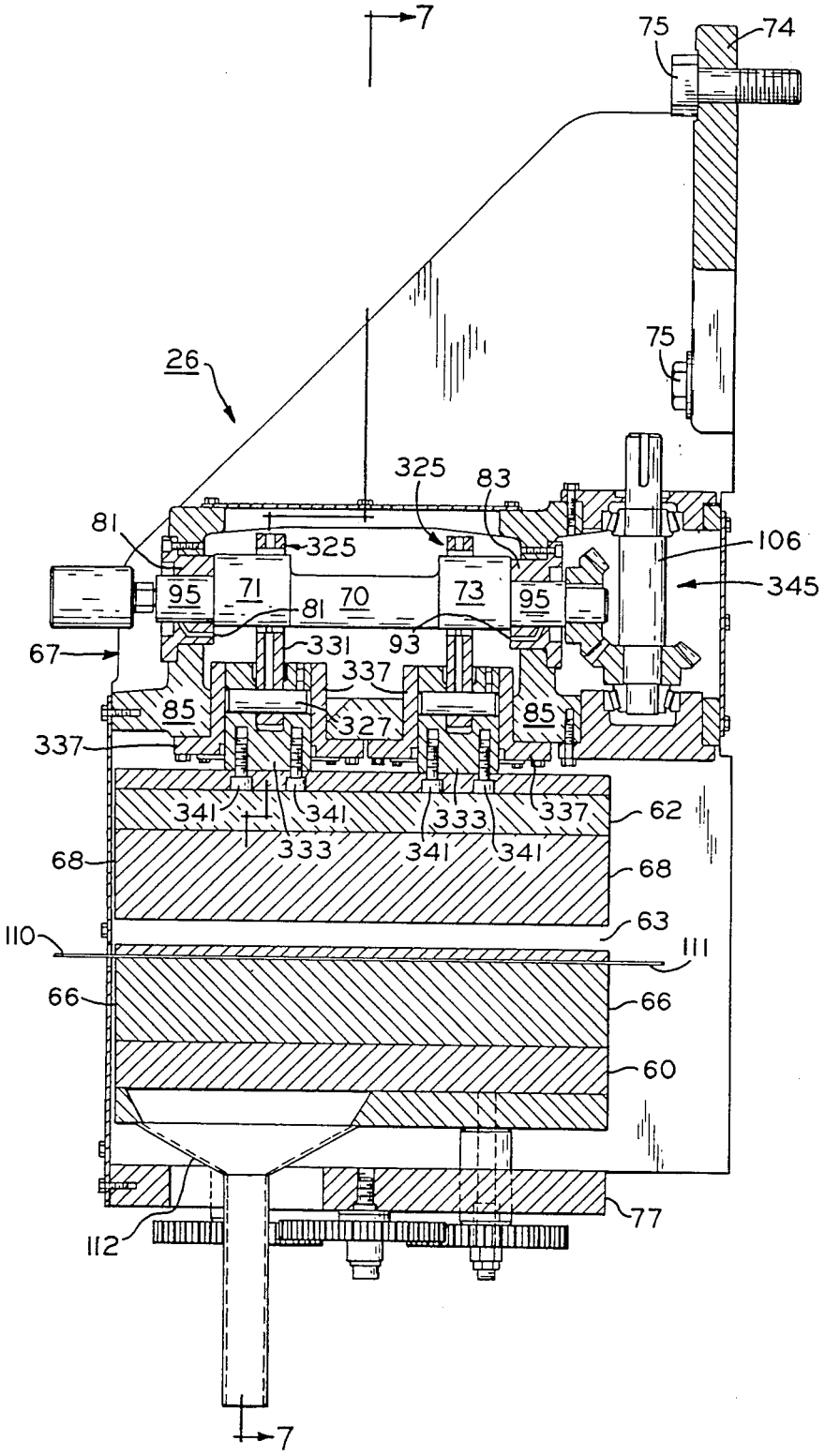
FIG. 6 is a sectional view taken along line 6—6 of FIG. 4 showing the tab press.
Figure 7:
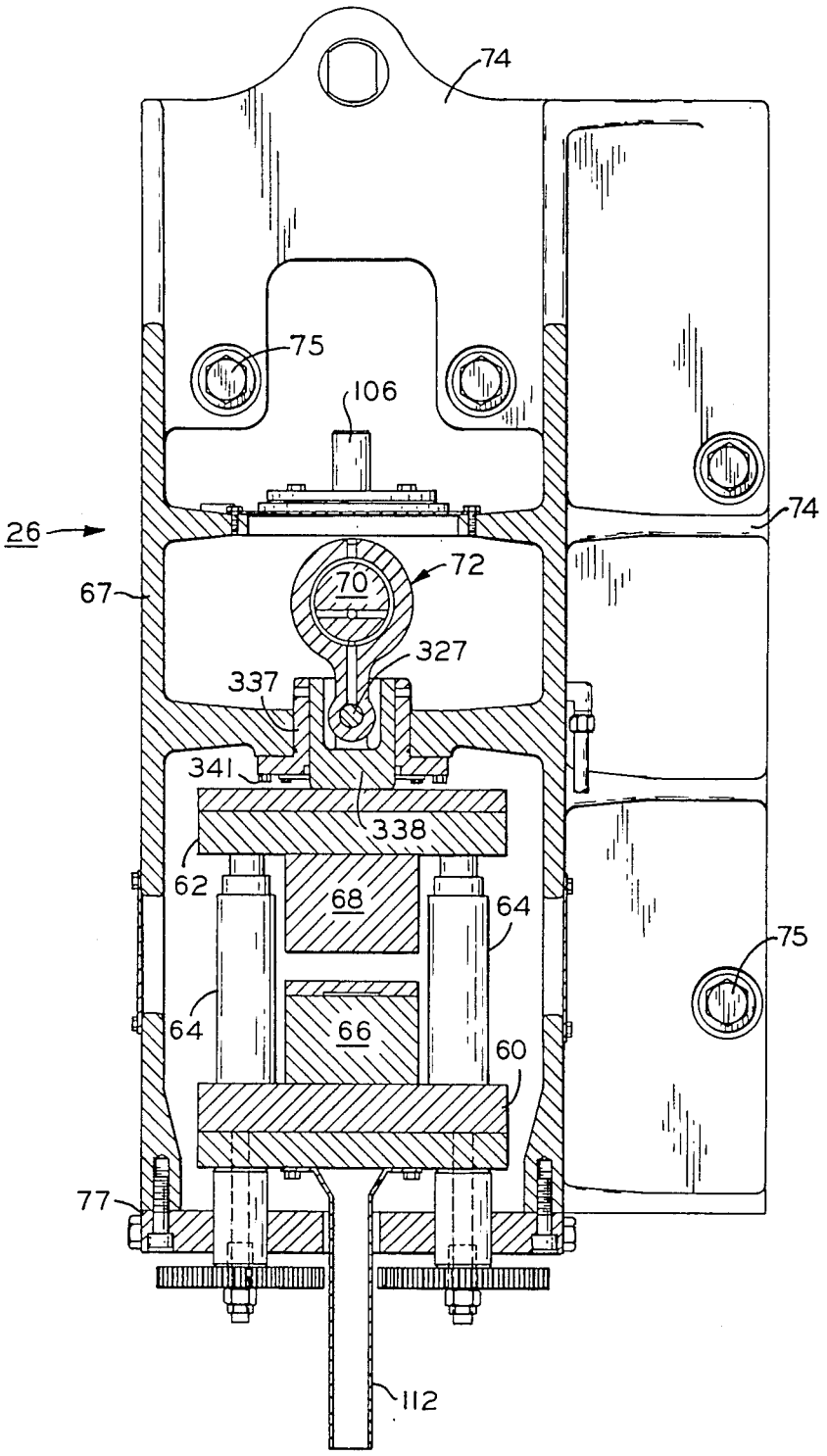
FIG. 7 is a sectional view of the tab press taken along line 7—7 of FIG. 6.

Tab press 26, which is illustrated in detail in FIGS. 6 and 7, is mounted on frame 14 and laterally displaced from working zone 36 of first press 11. In other words, tab press 26 is displaced laterally from a vertical plane which coincides with the axis 45 of transfer conveyor 24 and out of working zone 36 and is located in such a manner that tabs are fed transversely into main press 11 relative to the axis 45 of movement of can end workpieces 135. Preferably, the tabs move in a direction perpendicular to axis 45. Tab press 26 includes a bolster 60, slide 62, guides 64, lower tab tooling 66 mounted on bolster 60 and upper tab tooling 68 mounted on slide 62. Tab press working zone 63 is defined between upper and lower tab tooling 66 and 68. Tab press bolster 60 is generally parallel to plane 47 of conveyor 24. Slide 62 is operably connected to second press crankshaft 70 and drive connection assembly 72 disposed within crown 67. Tab die press 26 is not provided with a stand-alone frame, but is mounted on frame 14 by first plate 74 and bolts 75. Bolted to plate 74 is lower plate 77.

Crankshaft 70 of tab press 26, as shown in FIGS. 6 and 7, comprises first eccentric 71 and second eccentric 73. Crankshaft 70 is rotatably supported within bearing blocks 81 and 83, which are supported on pads 85 in crown 67. Connection assembly 72 comprises two connection arm assemblies 325 each comprising a wrist pin 327 and a connecting arm 331. Connecting arms 331 are connected to crankshaft eccentrics 71 and 73. Each connection arm assembly 325 further includes pistons 333 connected to connection arms 331 by wrist pins 327. Pistons 333 are slidably received in cylinders 335, the latter including flanges 337 and 339 connected to the lower surface of crown 67. Slide 62 is connected to pistons 333 by bolts 341.

Crankshaft 70 is shown in FIGS. 6 and 7 as being coupled to gearing 345, which is connected as shown in FIG. 1 through a universal joint 108, drive shaft 106, universal joint 104 and a change direction gearbox 102, which is connected to crankshaft 80 by belt 103 (FIG.

4). Scrap cutter 44 is similarly coupled to crankshaft 82 by a series of belts 44a and 44b as shown in FIG. 4.

Main press 11, tab press 26, belt drive 24, scrap cutter 44, downstacker 28 and upstacker 30 are all coupled to motor 22 and crankshaft 82 to be driven thereby. As shown in FIGS. 2 and 10, motor 22 is connected to pulley 199, which is coupled to crankshaft 82 by flywheel 194 and belt 198. Crankshaft 82 is coupled to gearbox 86 by belt 85 and to drive pulley 48 of transfer belt 46 through universal joint 88, drive shaft 90, universal joint 92 and change direction gearbox 94. Power from crankshaft 82 is further transmitted through gearbox 98 to drive belt 100, which drives downstacker 28.

Figure 4:
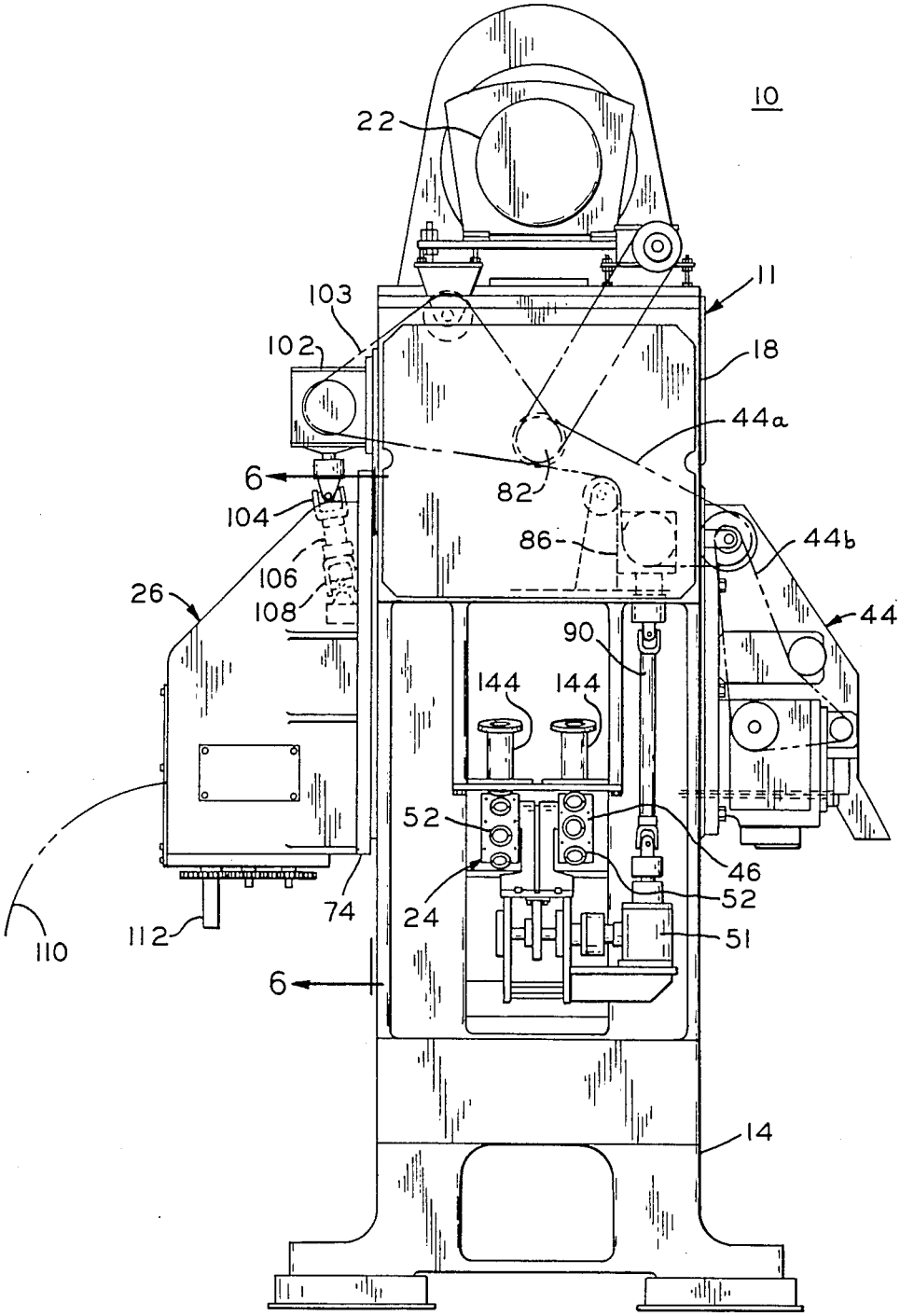
FIG. 4 is a righthand elevational side view of the press assembly.

As shown in FIG. 4, strip stock 110 is provided to tab die press 26 from a coil (not shown) and is led between tab tooling 66 and 68 for formation of the tabs. Thereafter, the strip carried tabs continue feeding between can end tooling 32 and 34 of main press 11 for staking the formed tabs 111 to formed can ends at a staking station within press 11 working zone 36. The skeleton 113 is pulled through press 11 by feed 44. A scrap cutter at the output of pull-through feed 44 shreds the skeleton 113. As shown in FIG. 6, scrap chute 112 is provided for discharging scrap from the tab forming operation of tab press 26.

Main press 11, tab press 26, transfer conveyor 24, downstacker 28 and upstacker 30 and the feed 44 are all synchronously operable by crankshaft 82. Transfer belt 46 receives blank can ends from downstacker 28, such as by vacuum transfer, for example. Transfer conveyor 24 is synchronously operable in plane 47 with the reciprocation of slide 20 to index between the stations of tooling 32 and 34 within working zone 36.

The tabs are formed in tab press 26 by tooling 66 and 68, which constitutes a progressive die assembly. The formed tabs 111 in the strip skeleton are continuously transferred from tab press 26 in synchronized motion with the vertical operation of slide 20 for staking to formed can ends on conveyor 24 at a final staking or mounting stage within working zone 36 (FIG. 5). Thereafter, the strip is continuously fed to scrap cutter 44 and transfer conveyor 24 provides finished can ends to upstacker 30 for ejection therefrom.

Figure 8A:
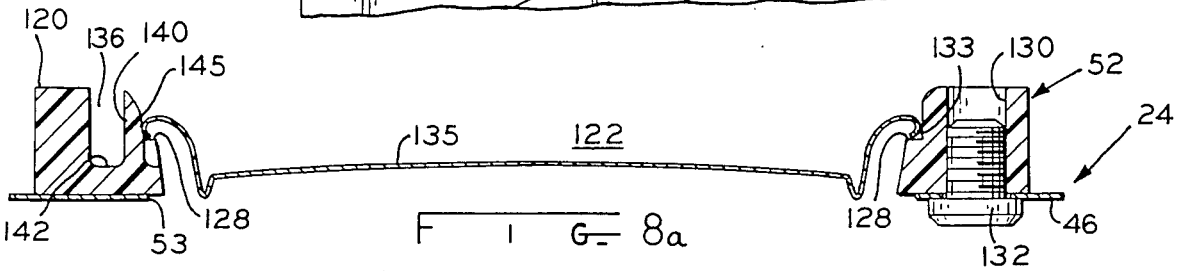
FIG. 8*a* is an enlarged sectional view of the transfer belt and carrier assembly.
Figure 8B:
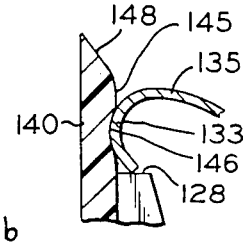
FIG. 8*b* is further enlarged view of a portion of the carrier.
Figure 8C:
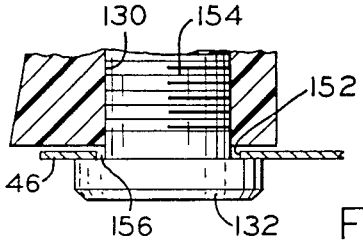
FIG. 8*c* is an enlarged sectional view of the attachment between the carrier and belt.

Referring now to FIGS. 8, 8*a* and 9, a preferred embodiment of the transfer belt is shown. Carriers 52 within apertures 53 of a flexible metal or fabric belt 46 comprise an annular body or collar 120, a bore 122, a first inner diameter 124 (FIG. 9), a second inner diameter 126 larger than the first diameter 124, and a shoulder 128 defined between the first and second diameters 124 and 126, respectively. The outer peripheral edge 133 of can end 135 is supported on shoulder 128. Carrier 52 may be made of a resilient plastic material, such as nylon, Delron or the like. Collar 120 and shoulder 128 are interrupted at three equidistantly spaced locations by recesses formed by circumferential slots 136 and pairs of radial slots 138, the latter extending from the smaller inner diameter 126 to intersect circumferential slots 136. This defines three upstanding resilient fingers 140 which extend upwardly from the lower surfaces 142 of the recesses formed by slots 136 and 138. It will be noted that the bottom surfaces 142 of these recesses are lower than the upper surface of generally annular shoulder 128, which permits fingers 140 to flex outwardly in a plane defined by the upper surface of shoulder 128.

The radially inner surfaces 145 of fingers 140 are positioned just slightly inside the circumference defined by the outer peripheral surface of can end 135 so that fingers 140 will be deflected outwardly by the presence of can end 135 in carrier 52. Each finger 140 also includes an inwardly facing recess or detent 146 adapted to resiliently capture the outer peripheral surface 133 of can end 135. It will also be noted that the upper inner surface 148 of finger 140 is angled relative to the direction of movement of can end 135 when loaded therein so as to provide a camming action causing finger 140 to deflect outwardly. Thus, fingers 140 flex outwardly when can ends 135 are inserted into carrier 52 in a downward direction and resiliently and frictionally hold can end 135 in place as the can end 135 is indexed through the various stations within main press 11. The combination of shoulder 128 and the resilient gripping of fingers 140 serve to accurately retain can ends 135 in place yet permit then to be inserted and ejected with low force. At the upstacker 30, formed can ends 135 are ejected from carriers 52 by means of ram 142 and thus loads the can ends 135 into magazine 144 (FIG. 8).

Collar 120 is connected to belt 46 by means of a threaded screw 132 received within a threaded bore 130 of collar 120. Screw 132 extends through an opening 152 in belt 46, and the opening 152 is larger in diameter than the outer diameter of the shank portion 154 of screw 152 in the area of the belt so that there is clearance 156 therebetween. This permits a certain amount of omnidirectional movement of collar 120 in the plane of belt 46 so that it can self-align with the downstacker 28 and can end tooling during loading and forming of the can ends.

Although the preferred embodiment of carrier 52 comprises three fingers 140, it is also possible to employ only two arcuate, equidistantly spaced fingers, or more than three fingers may be utilized if desired.

As discussed earlier, main press 11 and auxiliary tab press 26, since they each comprise their own crankshaft, can be adjusted independently of each other. For example, the shutheight of each press 11 and 26 can be independently adjusted by utilizing standard shutheight adjustment mechanisms. Furthermore, the stroke lengths of the presses can be independently selected because the tab tooling and can end tooling is carried by separate slides and is driven by separate crankshafts. By way of example only, the stroke length for main press 11 can be selected at $1\frac{3}{4}$ inches whereas the stroke for tab press 26 can be selected as $\frac{3}{4}$ inch. The phase relationship between the presses 11 and 26 can be adjusted by any appropriate known method. For example, timing belt 103 can be disengaged from the drive for either or both of crankshafts 82 and 70, the crankshafts then rotated to their appropriate phase relationship, and timing belt 103 again attached. Other phase adjustment mechanisms, such as adjustable clutches, adjustable cogs and collars, and the like can also be employed.

While this invention has been described as having a preferred design, it will be understood that it is capable of further modifications. This application is, therefore, intended to cover any variations, uses, or adaptations of the invention following the general principles thereof and including such departures from the present disclosure as come within known or customary practice in the art to which this invention pertains and falls within the limits of the appended claims.

What is claimed is:

1. In a press assembly for producing easy-open can ends having reciprocating, multiple station tooling means for performing successive forming operations on can end workpieces and for attaching tabs to the can end workpieces to form can ends, transfer means for moving can end workpieces through said press stations comprising:

an endless flexible belt, a drive means for driving said belt through the tooling stations of said press in a direction perpendicular to the direction of reciprocation of said tooling means, and a plurality of can end carriers secured to and carried by said belt, each of said carriers comprising a shoulder adapted to support an outer edge of a can end workpiece, said can end carrier comprising at least three self-resilient fingers made from a material inherently capable of elastically flexing radially outwardly for resiliently receiving a can end workpiece, each of said fingers having detent means therein for gripping the outer edge of a can end workpiece.

2. The press assembly of claim 1 wherein said carrier comprises a generally annular collar and a central opening, said collar having a first inner diameter, a larger second inner diameter and said shoulder located at the junction of said first and second diameters.

3. The press assembly of claim 2 wherein said fingers comprise radially inward surfaces that are positioned along a circumference that is slightly smaller in diameter than said second diameter.

4. The press assembly of claim 3 wherein said fingers are located in recesses in said collar and project upwardly from lower surfaces in said recesses, said lower surfaces being lower than said shoulder.

5. The press assembly of claim 1 wherein said fingers comprise radially inward surfaces that are positioned along a circumference that is slightly smaller in diameter than said second diameter.

6. The press assembly of claim 1 wherein said fingers are located in recesses in said shoulder and said fingers project upwardly from lower surfaces in said recesses, said recess lower surfaces being lower than said shoulder whereby said fingers can flex outwardly in a plane generally coplanar with said shoulder.

7. The press assembly of claim 1 wherein said carrier is of a resilient plastic material.

8. The press assembly of claim 1 including fastener means for connecting said carriers to said belt.

9. The press assembly of claim 1 wherein said carriers are secured to said belt by means for permitting limited transverse and axial movement of said carriers relative to said belt, whereby the carriers and can ends carried thereby can automatically be aligned with tooling within the press.

10. The press assembly of claim 9 wherein said means for permitting movement comprises fastener means connecting said carrier to said belt, wherein there is clearance between said fastening means and one of said carrier and said belt.

11. In a press for producing can ends having multiple station tooling means for performing successive operations on can end workpieces, a transfer system for moving said can end workpieces through said press, said transfer system comprising:

an endless flexible belt, and a plurality of can end carriers secured to and carried by said belt, each of said carriers comprising a shoulder adapted to support an outer edge of a can end workpiece and at least three cantilevered, generally vertical self-resilient fingers made from a material inherently capable of elastically flexing radially outwardly to receive a can end workpiece, said fingers having detent means therein for gripping the outer edge of a can end workpiece.

12. The press assembly of claim 11 wherein said carrier comprises a generally annular collar and a central opening, said collar having a first inner diameter, a larger second inner diameter and said shoulder located at the junction of said first and second diameters.

13. The press assembly of claim 17 wherein said fingers comprise radially inward surfaces that are positioned along a circumference that is slightly smaller in diameter than said second diameter.

14. The press assembly of claim 11 wherein said fingers are located in recesses in said shoulder and said fingers project upwardly from lower surfaces in said recesses, said recesses lower surfaces being lower than said shoulder whereby said fingers can flex outwardly in a plane generally coplanar with said shoulder.

15. The press assembly of claim 11 wherein said carriers are secured to said belt by means for permitting limited transverse and axial movement of said carriers relative to said belt, whereby the carriers and can ends carried thereby can automatically be aligned with tooling within the press.

16. The press assembly of claim 15 wherein said means for permitting movement comprises fastener means connecting said carrier to said belt, wherein there is clearance between said fastening means and one of said carrier and said belt.

17. In a press assembly for producing easy-open can ends having reciprocating, multiple station tooling means for performing successive forming operations on can workpieces and for attaching tabs to the can end workpieces to form can ends, transfer means for moving can end workpieces through said press stations comprising:

an endless flexible belt, a drive means for driving said belt through the tooling stations of said press in a direction perpendicular to the direction of reciprocation of said tooling, and a plurality of can end carriers secured to and carried by said belt, each of said carriers comprising a generally annular shoulder adapted to support an outer edge of the can end workpiece, said can end carrier comprising at least three resilient fingers extending generally upwardly and having detent means therein for gripping the outer edge of the can end workpiece, said fingers being located in recesses in said shoulder and said fingers projecting upwardly from lower surfaces in said recesses, said recess lower surfaces being lower than said shoulder whereby said fingers can flex outwardly in a plane generally coplanar with said shoulder.

* * * * *

UNITED STATES PATENT AND TRADEMARK OFFICE

CERTIFICATE OF CORRECTION

PATENT NO. : 4,799,846

DATED : January 24, 1989

INVENTOR(S) : Terry L. Wissman

It is certified that error appears in the above-identified patent and that said Letters Patent is hereby corrected as shown below:

Claim 13, Col. 10, line 16, change "17" to --12--.

Signed and Sealed this

Thirteenth Day of June, 1989

*Attest:*

DONALD J. QUIGG

*Attesting Officer*

*Commissioner of Patents and Trademarks*